United States Patent [19]

Rhoads

[11] Patent Number: 4,602,597

[45] Date of Patent: Jul. 29, 1986

[54] VARIABLE PUSH ROD

[76] Inventor: Gary E. Rhoads, 8565 Boulder Dr., La Mesa, Calif. 92041

[21] Appl. No.: 586,265

[22] Filed: Mar. 5, 1984

[51] Int. Cl.[4] ..... F01L 1/34

[52] U.S. Cl. ..... 123/90.15; 123/90.63

[58] Field of Search ..... 123/90.63, 90.15, 90.61, 123/90.62

[56] References Cited

U.S. PATENT DOCUMENTS

| | | | |
|---|---|---|---|
| 2,739,580 | 3/1956 | Brown | 123/90.63 |
| 2,878,796 | 3/1959 | Mannerstedt | 123/90.63 |
| 3,109,418 | 11/1963 | Exline et al. | 123/90.63 |
| 3,418,983 | 12/1968 | Sossna | 123/90.63 |
| 3,963,007 | 6/1976 | Baker | 123/90.63 |

*Primary Examiner*—Craig R. Feinberg
*Assistant Examiner*—David A. Okonsky

[57] ABSTRACT

The present invention relates to push rods for an internal combustion engine and more particulary to a hydraulic push rod. A new and useful hydraulic push rod of which varies valve timing automatically, improves low end horsepower by altering valve opening and closing degrees, or points of opening in relationship to the crankshaft. While engine rpms increase, valve duration and overlap also increase automatically for a large flow of fuel at higher engine rpms. This novel device also improves fuel economy and smog pollutant emissions.

3 Claims, 3 Drawing Figures

VARIABLE PUSH ROD

BACKGROUND AND SUMMARY OF THE INVENTION

With conventional push rods each push rod is constructed of a solid steel rod, sometimes having a oil feed hole through the center feeding the rocker arm. Each push rod seats in a lifter, and the lifter body rides on one lobe of the camshaft, the other end pushes the rocker arm, allowing the valves to open and close. Fixed units open and close the valves only. Mechanical systems do one specific job, having no allowance of worn parts (as hydraulic valve lifters that remain at zero valve lash). Push rods are designed to follow the cam and lifter characteristics, solid lifters maintain a fixed adjusted lash setting which remain inflexable, a wide lash setting causes wear over that of a hydraulic lifter being fed under oil pressure which maintains a tight setting at all times allowing for wear and other variables. Many lifters are designed to trap oil in the body chamber and expand beyond its predetermined zero valve lash point, holding the valves open at high speeds causing valve float. However, with high performance cams the valves are timed to have considerable overlap and duration in order to provide for a large fuel flow through the engine. At low speeds this large overlap is not necessary and the engine runs inefficiently, resulting in a loss in low speed horsepower. Basically, increasing the valve lash will shorten valve duration and reduce overlap, increasing crankshaft rotating degrees in relationship to the valves. This results in an improvement in low speed performance. However, excessive lash causes considerable noise, wear and loss of horsepower at higher revolutions per minute (rpms).

The novel hydraulic valve timing push rod varies valve timing automatically, by increasing or widening valve lash at low speeds, improves low end torque horsepower, yet while engine speeds increase, the hydraulic push rod allows for expansion, decreasing valve lash, consequently lengthening valve duration and overlap, improving high speed performance.

Refer to the variable hydraulic valve lifter filed June 20, 1966, U.S. Pat. No. 3,304,925 by my late father James E. Rhoads and also another U.S. Pat. No. 3,921,609 filed Aug. 16, 1974, both being hydraulic variable valve lifters which work on the same principles, with a few exceptions being basically incorporated in a push rod and particularly having external aperture bleed adjustments, meticulously controlling the rate of bleed for valve delay.

The push rod herein described is designed to prove favorable characteristics over the other two patents which work basically on the same principle. The push rod having multiple favorability, number one the engine need not be majorly disassembled for installation, easy installation requires only the removal of valve covers and rocker arms, drop in device and reassemble, while lifter removal requires a more invalved disassembly for example pulling off the intake manifold and other involvements. Another benefit is the push rod may be placed in foreign car engines, not equipped for hydraulic valve lifters, a non manufactured item, they too can have a variable valve timing device that will result in a considerable horsepower increase, fuel economy and improving smog pollutant emissions.

BRIEF DESCRIPTION OF THE INVENTION

The main object of the invention resides in the provision of a hydraulic push rod.

Another object of the invention is the provision of a variable lash adjustable push rod.

Another object of the invention is the provision of an adjustable aperture bleed within the structure having an exterior aperture adjustment that may be adjusted outside of the unit to control bleed rate for specific cam profiles.

Another object of the invention is the provision of a two-way valve within the push rod structure allowing a bleed within the pressure chamber.

Another object of the invention is the provision of a lash adjustment as well as a aperature bleed adjustment.

Another object of the invention is the provision of a non adjustable two-way valve capillary tube being a restricted oil bleed.

A further object of the invention is the provision of an internal bleed system controlled at all points of the hydraulic push rod.

The novel features of which I consider characteristic of my invention are best set forth with particularity in the apparent claims. The invention itself, however, both as to its organization and mode of operation, together with additional objects and advantages thereof, will best be understood from the following description of specific embodiments when read in connection with the accompanying drawings.

DETAILED DESCRIPTION OF THE PREFERRED EMBODIMENTS

Figure 1:
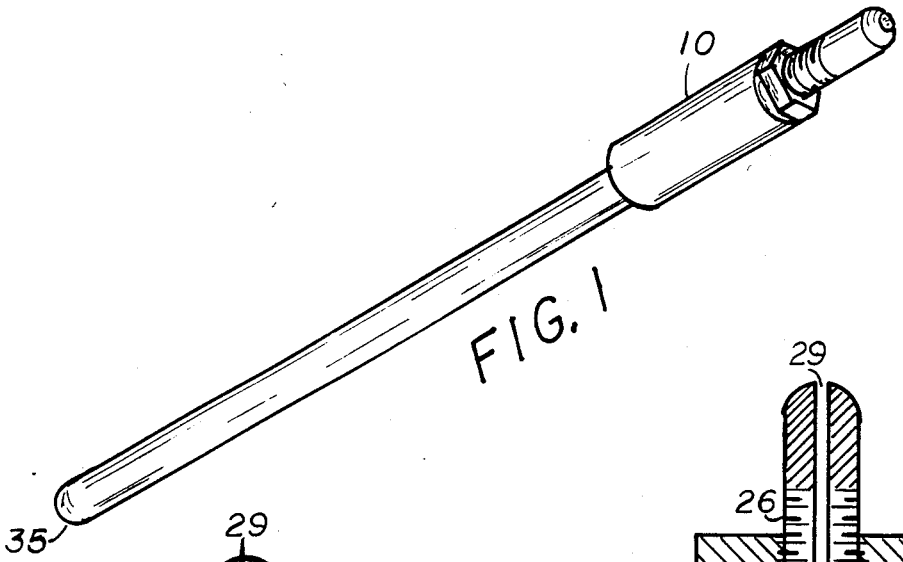
FIG. 1 is a perspective view of the preferred embodiment.

FIG. 1 shows embodiment 10 having a lower end 35 that rides in a valve lifter, which follows one lobe on a driven camshaft, in turn the upper end 29 engages with a rocker arm located on the cylinder head so as to open the intake and exhaust valves within the cylinder head of a internal combustion engine (related parts not shown).

Figure 2:
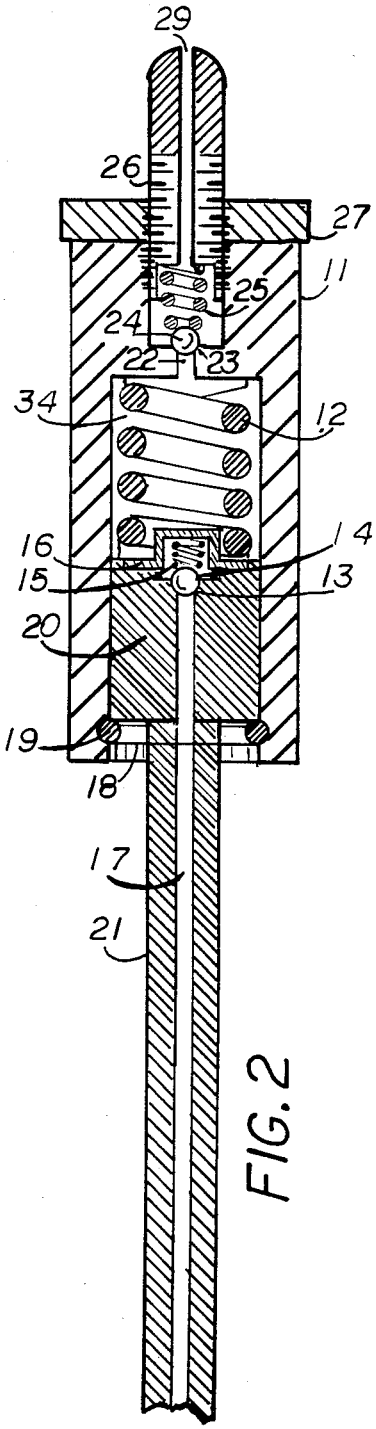
FIG. 2 is a sectional view showing of the adjustable preferred embodiment.

FIG. 2 shows embodiment 10 having a outer cylindrical body 11 and axially slidable within the body is a hollow cylindrical plunger 20. In the upper end of plunger 20 is a check valve seat 13 in which is seated a check valve 14 biased downwardly by a spring 15 and held in place with a perforated retaining cage 16. Oil is fed through oil feed hole 17 of the lower portion of push rod 21. Plunger 20 is retained by a snap ring 19 in a groove 18 within the lower end of body 11. Body 11 has an internal oil relief escape aperture hole 22. Located on the top of hole 22 is a check valve seat 23. Engaged with said seat is a valve 24 held by a valve spring 25 and retained with a threaded push rod aperture control adjustment 26 and locked by a nut 27, of which adjust for a meticulous tension so as to open valve 24 under pressure whereby a meticulous bleed takes place and delays the opening of the engine valves, decreasing valve duration for improved low end performance. As rpms increase, oil due to turbulence has no time to bleed, resulting in a pumping up or a non leak factor, improving top rpm engine performance.

Figure 3:
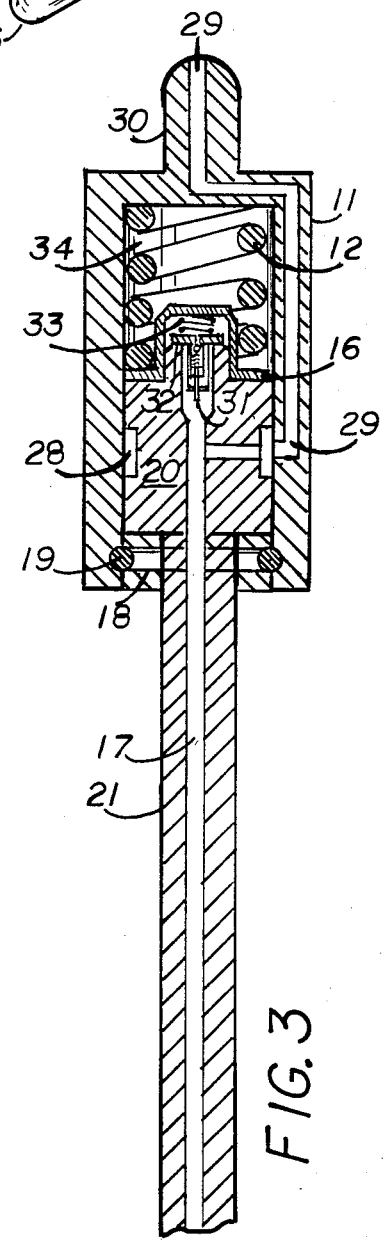
FIG. 3 is a sectional view of an alternative unit.

FIG. 3 shows a alternative system having basically the same function, with the exception of the outer adjustment, controlling the aperture opening for the meticulous oil bleed rate. FIG. 3 having alternative oil bleed and means of oil escape, numeral 28 shows a peripheral oil collecting channel where oil is constantly fed through oil gallery 29, lubricating upper end of push rod 30. Oil from chamber 34 leaks out 31 for delay.

Internal plunger 20 of FIG. 3 shows a check valve seat 32 engaged with a two-way valve 31, of which comprises a secondary internal check valve seat, secondary valve, a spring, adjusting screw and a lock nut, of which is a very meticulous pre-adjusted drop in two-way valve. Valve 31 is biased downwardly by spring 33 held by a perforated cage 16. The functions of FIG. 3 are competitive to FIG. 2. The two-way valve is in Patent Pending filed Feb. 21, 1984, a variable two-way valve.

The device as shown can of course by modified within the scope of the appended claims and specifically here are some modifications which might be desirable.

One of the main features besides the novel hydraulic push rod in itself, is the provision of a internal bleed system for altering valve opening and closing points, changing valve duration and overlap automatically.

This bleed system may be altered in many ways; plunger 20 for example may have a groove machined on the surface as a oil relief escape. Scratches on the internal cylinder within the body 11, not practical but possible. Altered check valves will cause a bleed. A hole drilled through body 11 perhaps with a screw in jet regulating bleed rates. A second escape valve located within the plunger 20, bleeding to feed line 17. There are many ways of controlling bleeding points.

Although I have described my invention with a certain degree of particularity, it is understood that the present disclosure has been made only by way of example and that numerous changes in the details of construction and the combination and arrangement of parts may be resorted to; without departing from the spirit and the scope of the invention as hereinafter claimed.

What is claimed is:

1. A variable push rod comprising:

a pushrod having a top end and a bottom end, an oil feed hole extending up through the interior of said pushrod from its bottom end to its top end;

a plunger connected to the top end of said pushrod, said plunger having an oil feed hole extending up through its interior and in communication with the oil feed hole in said pushrod, a primary check valve seat is formed at a top end of the oil feed hole in said plunger;

a cylindrical body member having a top end and a bottom end, a primary oil chamber formed in an upper portion of said body member, said plunger positioned in said oil chamber and functioning as a piston that can travel up and down in said oil chamber;

means for retaining said plunger in said oil chamber;

a primary check valve seatably positioned on said primary valve seat and means for maintaining said primary check valve seated during an upward stroke of said pushrod; and a passage formed in said body member and exiting out said top end, an internal oil relief escape hole connecting the passage in said body member with said primary oil chamber, a secondary check valve seat formed about said oil relief escape hole and in a bottom area of said passage, a secondary check valve suitably positioned on said secondary check valve seat and means for adjusting the amount of pressure to keep said secondary valve closed and also locking said means at that predetermined pressure.

2. A variable pushrod as recited in claim 1 wherein said means for maintaining said primary check valve seated during the upstroke of said pushrod comprises a first spring held in place by a perforated retaining cage which in turn is held in place by a second spring whose upper end engages the top surface of said primary oil chamber.

3. A variable pushrod as recited in claim 1 wherein said passage is internally threaded and said means for adjusting the amount of pressure to keep said secondary valve closed comprises an externally threaded rod member that is screwed into said threaded passage, said rod member having a longitudinally extending oil feed hole that is in communication with a secondary oil chamber formed by the bottom area of said passage, a pressure adjustment spring has its bottom end bearing against said secondary check valve and its top end bears against a bottom end of said rod member.

* * * * *